US005927550A

United States Patent [19]

Mack et al.

[11] Patent Number: 5,927,550

[45] Date of Patent: Jul. 27, 1999

[54] DUAL CHAMBER TUBULAR CONTAINER

[75] Inventors: Robert John Mack, Flemington, N.J.; James C. McKinney, Peachtree City, Ga.; Patrick Andre Connan, Lebanon, N.J.

[73] Assignee: Colgate-Palmolive Company, New York, N.Y.

[21] Appl. No.: 08/978,891

[22] Filed: Nov. 26, 1997

Related U.S. Application Data

[60] Provisional application No. 60/032,339, Dec. 4, 1996.

[51] Int. Cl.[6] ..... B65D 35/22

[52] U.S. Cl. ..... 222/94

[58] Field of Search ..... 222/94

[56] References Cited

U.S. PATENT DOCUMENTS 1,894,115 1/1933 Murphy .
3,788,520 1/1974 Dukess .
3,991,294 11/1976 Evans .
5,307,954 5/1994 Gick .
5,628,429 5/1997 Usen .

FOREIGN PATENT DOCUMENTS 961154 5/1950 France .
2017292 10/1971 Germany .

*Primary Examiner*—Kevin P. Shaver
*Attorney, Agent, or Firm*—Michael McGreal

[57] ABSTRACT

The dual chamber tubular container is closed at one end by a crimp seal and at the other end has a dispensing opening with a dividing wall. This dividing wall is attached longitudinally to the tubular chamber sidewalls and extends from the crimp seal to the dispensing opening divider wall. The divider wall of the dispensing exit as offset from the crimp seal about 75° to about 110° C. and preferably about 90°. This enhances the uniform dispensing of the two contained sub stances.

12 Claims, 1 Drawing Sheet

DUAL CHAMBER TUBULAR CONTAINER

This application claims benefit of Provisional Appln. 60/032,339 filed Dec. 4, 1996.

FIELD OF THE INVENTION

This invention relates to dual chamber tubular containers and the structure of the divider wall. More particularly, this invention relates to dual chamber tubular containers and the relationship of a lower crimp seal and an upper exit divider wall.

BACKGROUND OF THE INVENTION

Dual chamber tubular containers for the delivery of two different substances when the tube is squeezed are known. A continuing problem with regard to such containers is to achieve a uniform dispensing of each component from the tubular container. This is the case whether the tubular container is squeezed from near the top or the bottom, or from any position around the circumference of the tubular container. Uniform dispensing is a significant problem. However, there is a solution through the use of a tube divider wall which for a round tubular container is (1) greater in lateral dimension than the diameter of the tubular container;

(2) generally "S" shaped with the ends of the "S" shape attached to the tubular container sidewall;

(3) located longitudinally in the crimp seal; and (4) the crimp seal and the opposite end dispenser opening divider wall being about 75° to 110°, and preferably about 90° out of phase; that is, the plane of the dispenser exit divider wall is offset from the plane of the crimp seal by about 75° to 110°, or preferably about 90°.

The prior art is disclosed by U.S. Pat. No. 1,894,115, U.S. Pat. No. 3,788,520 and German Patent 2017292. In the two U.S. Patents, it is seen that the crimp seal and the dispensing exit divider wall are in the same plane. The divider wall is longitudinally situated in the crimp seal, but there is no angular offset of the crimp seal and the wall of the dispensing opening. One reason is that the divider wall does not have a sufficient lateral dimension. Another reason is that the prior art did not understand ways to achieve a highly uniform dispensing from essentially each chamber regardless of where the tubular container is squeezed to dispense the products. German Patent 2017292 discloses a tube where the crimp seal and the tube exit are in an angular offset. However, the divider wall is not longitudinally situated in the crimp seal.

BRIEF SUMMARY OF THE INVENTION

Dual chamber tubular containers that are crimp sealed at one end and which dispense separately contained products at the other end will more uniformly dispense the products if the tube divider wall is located longitudinally in the crimp seal and the crimp seal and the dispensing end divider wall are offset by about 75° to about 110°, and preferably about 90°. The tubular container divider wall at a lower end will lie in a single layer laterally across the crimp seal; that is, it will be disposed within the crimp seal. Thus, in the crimp seal there will be a three layer seal. The divider wall will have a lateral dimension greater than the cross-section of the tube and will be generally in an "S" shape within the tube body.

The dispensing exit will be offset at the above angles from the crimp seal. Also, the divider web wall will be about one-half or more the circumference of the tubular container for a round tubular container. In this way the divider wall can be disposed within the crimp seal. The crimp seal usually will be a linear dimension of about one-half the circumference of the tube. Also, there is provided a sufficient lateral dimension to the divider wall so that the divider wall can adopt an "S" shape. The "S" shape will be more pronounced adjacent the upper end of the tubular container. The net effect is a spiral like change of shape of the divider wall from the crimp seal up to and through the exit divider wall. The exit divider wall is connected to the inner divider wall of the tubular container so that the contained substances remain separate until the substances are dispensed.

This arrangement of the crimp seal and the divider wall in the nozzle exit of the tubular chamber provides for an ease in dispensing and a more uniform dispensing of the contained substances regardless of how the tube is held and squeezed. Since a tubular container having a crimp seal usually is held with the fingers on the tube body on each side of the crimp seal for dispensing, the nozzle exit will be aligned with the nozzle divider wall in a vertical position so that the substances are dispensed side by side. In this way the visual effectiveness of the uniformity of the dispensing constantly can be evaluated and the pressure applied to different parts of the tube varied to adjust the amount of product from each chamber.

BRIEF DESCRIPTION OF THE INVENTION

DETAILED DESCRIPTION OF THE INVENTION

The present invention is directed to a dual chamber tubular container having a lower crimp seal where the crimp seal and the dividing wall at the exit dispensing end are offset by about 75° to about 110°, and preferably about 90°. The divider wall of the dual chamber container will be disposed within the crimp seal and will rotate so that it is offset about 75° to about 110°, and preferably about 90°, from the crimp seal at the dispensing exit. In order to be disposed within the crimp seal, the divider wall will have to be at least about one-half the circumference of the tubular container, and preferably more, when the tubular container is round. The divider wall also will be in an "S" shape with the divider wall rotating about 75° to about 110°, and preferably about 90°, as it passes from the crimp seal to the exit. This provides for a spiraling of the center wall as it extends from the crimp seal to the exit of the tubular container.

Figure 1:
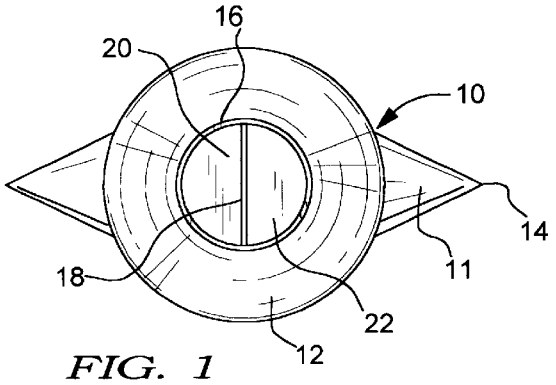
FIG. 1 is a top plan view of the tubular container of this invention.

The present tubular container is shown in FIG. 1. Tubular container 10 has sidewall 11 and shoulder 12. The shoulder terminates in nozzle 16 which has an aperture having openings 20 and 22. Divider wall 18 separates chamber 20 from 22. The divider wall 18 extends downwardly to the crimp seal 14. The crimp seal is shown as being offset 90° from the plane through the divider wall at the nozzle exit of the tubular chamber.

Figure 2:
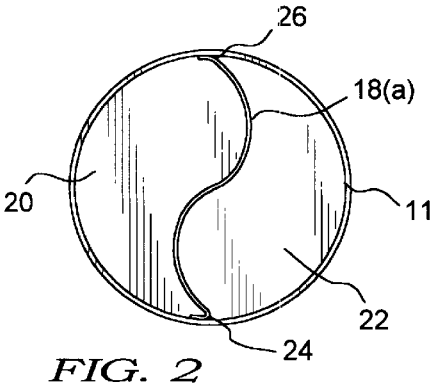
FIG. 2 is a cross-sectional view of the tubular container at about the mid-point of the tubular container.

FIG. 2 shows the divider wall 18(*a*) at a point about halfway between the crimp seal 14 and the nozzle 16. It is seen that the divider wall at this point has an "S" shape and has a length that is approximately one-half the circumference of the tubular container. In this way the divider wall 18(*a*) can be disposed within the crimp seal 14. This will produce a three layer seal. This divider wall has a high degree of flexibility.

It is preferred that the divider wall 18(*a*) be substantially less in thickness than the sidewall 12 and that it be more pliable. The divider wall will have a thickness of about 0.05 mm to about 0.15 mm and preferably about 0.07 mm to about 0.13 mm. The sidewall will have a thickness of about 0.2 mm to 0.8 mm and preferably about 0.2 mm to 0.6 mm.

Figure 3:
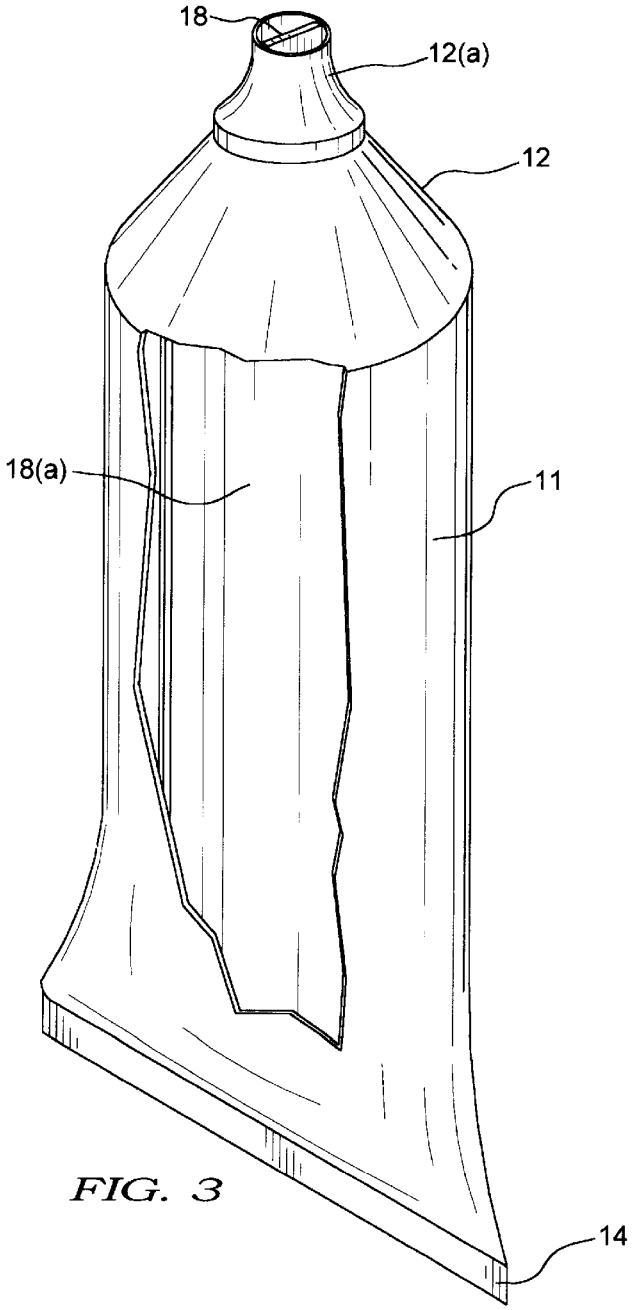
FIG. 3 is a partial cut-away tubular container showing the structure of the divider wall.

FIG. 3 shows the divider wall in more detail in the full construction of the tube. It is seen that the divider wall extends down through the tube to the crimp seal 14. Further, the exit divider wall is shown offset from the crimp seal by about 90° C. There is a spiraling of the divider wall 18(*a*) from the crimp seal up to and through the exit divider wall 18. This spiral nature to the divider wall, the general "S" shape of the divider wall, and the relatively thin structure of the divider wall, all contribute to a uniform dispensing of products from each chamber of the tube. Uniform dispensing is a necessary feature for dual chamber and other multichamber tube containers. The cylindrical portion of the tube terminates in shoulder 12 and a nozzle 12(*a*).

The sidewalls and the inner divider web wall can be comprised of a single layer or multilayer laminate structure. The useful materials include polypropylene, polyethylene (high to low density), polybutadiene, ethylene vinyl alcohol, ethylene vinylacetate, vinylidene chloride, polyethylene terephthalate, polybutylene terephthalate, polyacrylonitile and laminate structures that use layers of these materials. In many instances the sidewall will be a laminate structure while the web wall will be a monolayer. It is preferred that the divider web wall be as thin as possible which makes a monolayer, and a thin multilayer, useful. However, the divider web wall can be of a multilayer structure depending on the barrier and other properties desired for this wall.

The present invention can be modified as to sidewall and divider web wall materials and characteristics. However, any modifications which functionally produce the same tubular container are within the present invention.

What is claimed is:

1. A dual chamber tubular container having an outer wall, a crimp seal at one end and a nozzle at another end, a center divider wall having a thickness less than said outer wall and extending from the crimp seal to said nozzle, said center divider wall having a lateral dimension at least about one-half the circumference of said tubular container, the lower end of said divider wall being disposed laterally within said crimp seal, said divider wall at said crimp seal being in a plane offset about 75° to about 110° from the plane of the divider wall at the nozzle and spirally rotating upwardly about 75° to about 110° from said crimp seal to said nozzle.

2. A dual chamber tubular container as in claim 1 wherein said divider wall has an "S" shape at a point about halfway between the crimp seal and the exit end.

3. A dual chamber tubular container as in claim 2 wherein said divider wall and said outer wall are composed of multilayer film.

4. A dual chamber tubular container as in claim 1 wherein the plane of said divider wall at said crimp seal and the plane of said divider wall at said exit end is offset about 90°.

5. A dual chamber tubular container as in claim 4 wherein said divider wall and said outer wall are comprised of a multilayer film.

6. A dual chamber tubular container as in claim 1 wherein said divider wall and said outer wall are comprised of a multilayer film.

7. A dual chamber tubular container as in claim 1 wherein said divider wall is comprised of a monolayer film and said outer wall is comprised of a multilayer film.

8. A dual chamber tubular container having an outer wall, a crimp seal at one end and a nozzle at another end, a center divider wall having a thickness less than said divider wall and extending from the crimp seal to said nozzle, said center divider wall having a lateral dimension greater than one-half the circumference of said tubular container, the lower end of said divider wall being disposed laterally within said crimp seal, said divider wall at said crimp seal being in a plane offset about 75° to about 110° from the plane of the divider wall at the nozzle and spirally rotating about 75° to about 110° upwardly from said crimp seal to said nozzle, said divider wall having an "S" shape at a point about halfway between the crimp seal and the nozzle.

9. A dual chamber tubular container as in claim 8 wherein said divider wall and said outer wall are comprised of a multilayer film.

10. A dual chamber tubular container as in claim 8 wherein the plane of said divider wall at said crimp seal and the plane of said divider wall at said exit end is offset about 90°.

11. A dual chamber tubular container as in claim 8 wherein said divider wall is comprised of a multilayer film.

12. A dual chamber tubular container as in claim 8 wherein said divider wall is comprised of a monolayer film and said outer wall is comprised of a multilayer film.

* * * * *